US005749585A

United States Patent [19]

Lembcke

[11] Patent Number: 5,749,585

[45] Date of Patent: May 12, 1998

[54] DOWNHOLE TOOL SEALING SYSTEM WITH CYLINDRICAL BIASING MEMBER WITH NARROW WIDTH AND WIDER WIDTH OPENINGS

[75] Inventor: Jeffrey J. Lembcke, Houston, Tex.

[73] Assignee: Baker Hughes Incorporated, Houston, Tex.

[21] Appl. No.: 573,824

[22] Filed: Dec. 18, 1995

[51] Int. Cl.[6] ..... F16J 15/06

[52] U.S. Cl. ..... 277/116.2; 277/117; 277/188 A; 166/217

[58] Field of Search ..... 277/215, 116.2, 277/116.6, 116.8, 117, 120, 188 A, 236; 166/118, 217; 267/180, 182, 181

[56] References Cited

U.S. PATENT DOCUMENTS

| | | | |
|---|---|---|---|
| 1,564,699 | 12/1925 | McCartney | 277/116.6 |
| 2,888,258 | 5/1959 | Hoffstrom | 267/181 |
| 2,977,980 | 4/1961 | Scholin | 267/180 |
| 3,109,493 | 11/1963 | Carter | 277/116.2 |
| 3,358,766 | 12/1967 | Current | 277/116.2 |
| 3,371,936 | 3/1968 | Beaudette | 277/117 |
| 3,389,917 | 6/1968 | McGill et al. | 277/116.2 |
| 4,043,546 | 8/1977 | Ashfield et al. | 267/181 |
| 4,573,537 | 3/1986 | Hirasuna et al. | 277/116.2 |
| 4,611,658 | 9/1986 | Salerni et al. | 277/116.2 |
| 4,730,835 | 3/1988 | Wilcox et al. | 277/117 |
| 4,745,972 | 5/1988 | Bell et al. | 277/116.2 |
| 4,858,897 | 8/1989 | Irifune | 267/181 |
| 5,195,759 | 3/1993 | Nicholson | 277/215 |

*Primary Examiner*—Scott Cummings
*Attorney, Agent, or Firm*—Rosenblatt & Redano, P.C.

[57] ABSTRACT

A sealing system, particularly useful for packers and anchors, is disclosed. The sealing element or elements are of a nonelastomeric material and are configured with a feature that can add a biasing force on one or both sides of the nonelastomeric sealing element(s) to allow the sealing element(s) to maintain the seal despite temperature or pressure fluctuations in the wellbore. The apparatus allows a packer with a nonelastomeric seal to be set at a broad range of downhole temperatures. The system includes a biasing member in the form of a cylindrical element having narrow width and wider width openings.

21 Claims, 3 Drawing Sheets

DOWNHOLE TOOL SEALING SYSTEM WITH CYLINDRICAL BIASING MEMBER WITH NARROW WIDTH AND WIDER WIDTH OPENINGS

FIELD OF THE INVENTION

The field of this invention relates to nonelastomeric sealing elements for use in downhole tools such as packers or plugs.

BACKGROUND OF THE INVENTION

Downhole tools such as packers have in the past used elastomeric sealing elements such as rubber. Elastomeric sealing elements have several advantages. One of the advantages of elastomeric sealing elements is that they have memory or elasticity. As a result, they tend to hold the seal against the casing, despite temperature fluctuations that can occur in the wellbore. Some of the disadvantages of elastomeric sealing elements for such downhole tools as packers are that their tolerance to certain environmental conditions in the wellbore is lower than many nonelastomeric materials. Additionally, elastomeric materials have temperature limits below those that can normally be expected in some applications. Resilient components have been used in downhole tools in a variety of different applications, either as seals or cushions for other movable components, as illustrated in U.S. Pat. Nos. 5,350,016; 4,711,326; 3,052,943; and 2,184,231.

In some applications where higher temperatures in the order of 350°–450° F. are encountered, prior designs have attempted to use nonelastomeric seals without any degree of commercial success. The nonelastomeric materials that have been employed, such as polytetrafluoroethylene, and commonly sold under the trademark Teflon®, while able to withstand the temperature limits, presented other disadvantages which made them unreliable. When even moderate temperature fluctuations occurred, loss of sealing contact with casing resulted. Furthermore, since the nonelastomeric materials had no memory, once the sealing element was misshapen under load, it was difficult, if not impossible, in prior designs to get the sealing element to reseal at a later time. Typically, in downhole operations, pressure shifts could occur where loading can reverse from coming below the sealing element to coming from above. Without the resilience and/or memory of the elastomeric materials, the nonelastomeric materials exhibited a tendency to lose their sealing grip upon such reversals of loading. This was because the elastomeric materials function akin to a combination of a spring and damper while the nonelastomeric materials function more akin to a damper acting alone. The nonelastomeric materials don't have the resilience to spring back after a change in loading and, due to loading changes induced by pressure or temperature effects, experienced leakage problems in prior designs.

Even in prior attempts to use nonelastomeric seals, service limits were placed on such packers in an effort to avoid application of nonelastomeric seals in downhole conditions where the seal could be lost due primarily to moderate temperature changes. Prior designs using nonelastomeric seals were limited to set temperatures downhole in the range of 350°–450° F. and maximum temperature fluctuations between hottest and coldest of approximately 100° F. Since downhole conditions in some cases were unpredictable and in most cases not controllable, application of nonelastomeric seals in prior packer designs led to unacceptable losses of sealing due to these temperature effects.

One of the objects of this invention is to allow a construction using nonelastomeric seals in downhole tools such as packers, but at the same time providing a solution to the difficulties encountered in past designs that have led to seal failures. Accordingly, a compensation system, in conjunction with nonelastomeric seals, is presented to address the shortcomings of the prior designs.

Prior designs using nonelastomeric seals with gauge rings on either side and slips that are located above and below the sealing element were configured to allow the uphole or downhole forces that could be exerted during the life of the packer to apply a boost force to the nonelastomeric sealing element. However, despite the configuration just described, the service limitations of such designs to avoid loss of seal were narrowly tailored to temperature fluctuations of no greater than 100° F. and setting temperatures at a range of about 350°–450° F. Thus, another object of the present invention is to provide a configuration where these service limits can be dramatically expanded without sacrificing the sealing reliability of the packer.

SUMMARY OF THE INVENTION

A sealing system, particularly useful for packers and anchors, is disclosed. The sealing element or elements are of a nonelastomeric material and are configured with a feature that can add a biasing force on one or both sides of the nonelastomeric sealing element(s) to allow the sealing element(s) to maintain the seal despite temperature or pressure fluctuations in the wellbore. The apparatus allows a packer with a nonelastomeric seal to be set at a broad range of downhole temperatures.

DETAILED DESCRIPTION OF THE PREFERRED EMBODIMENT

Figures 1A, 1B, 1C:
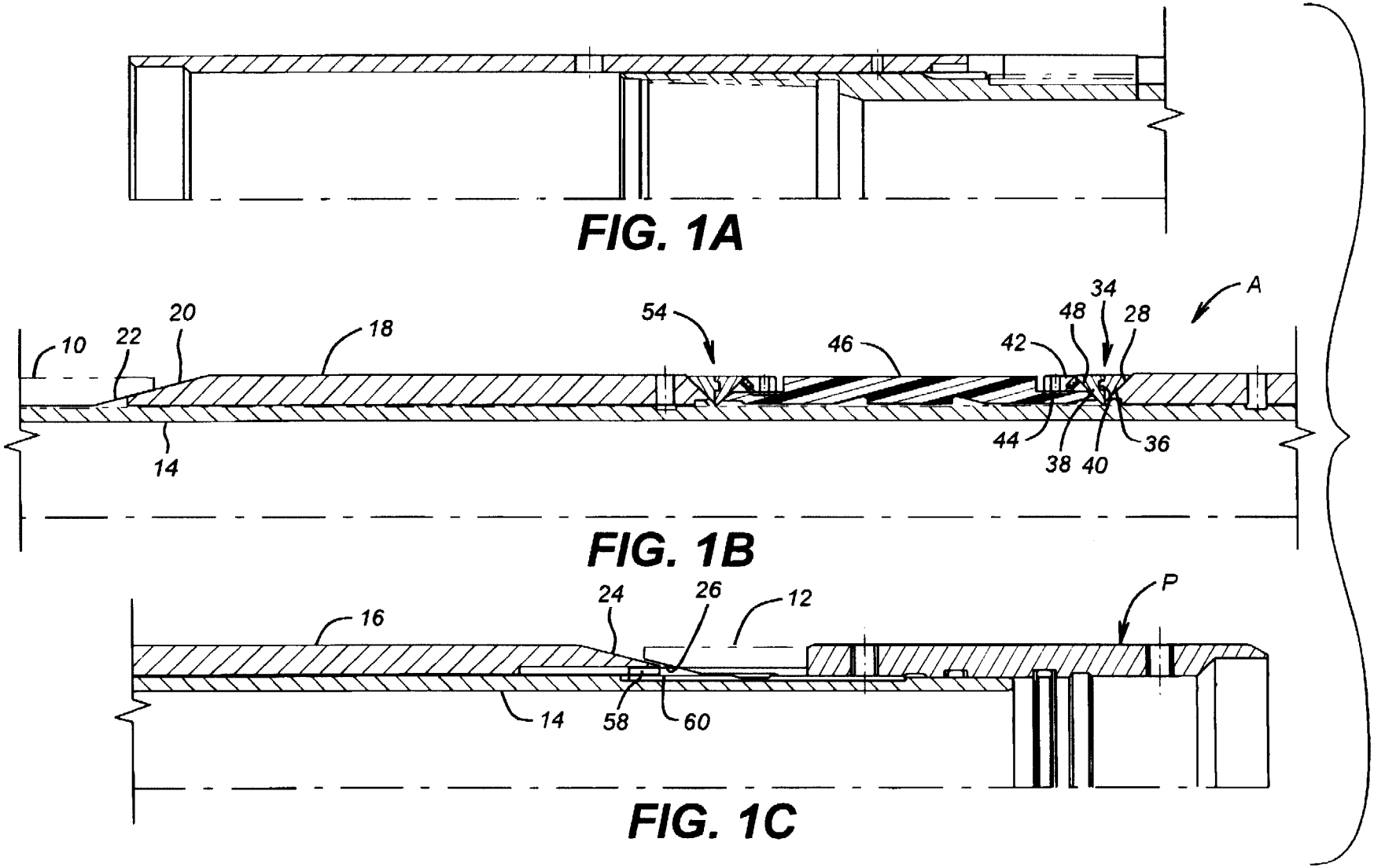
FIGS. 1A–1C is a sectional elevational view of the sealing system for a typical packer, illustrating the nonelastomeric seal in the run-in position.
Figure 3:
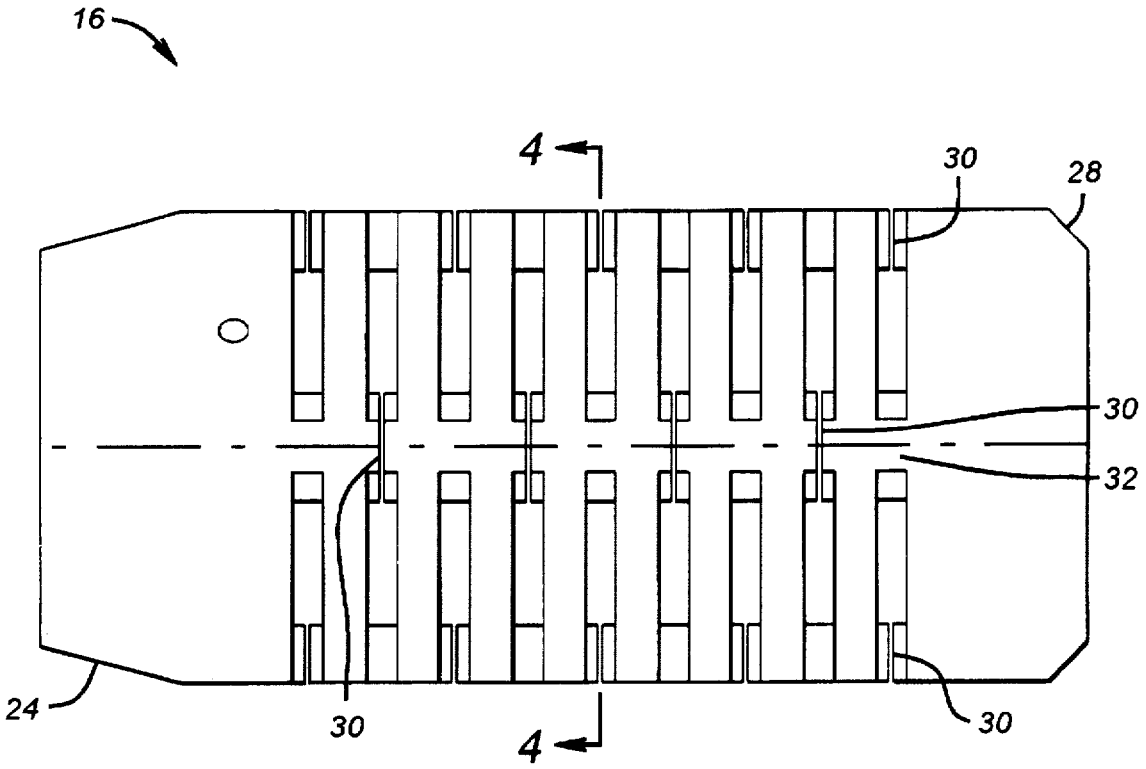
FIG. 3 is a sectional elevational view of the biasing member acting on the nonelastomeric seal.
Figure 4:
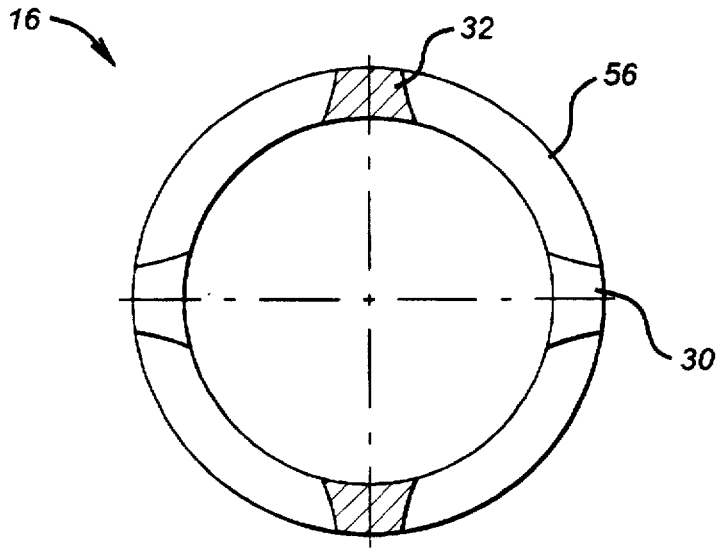
FIG. 4 is a section view along lines 4—4 of FIG. 3.

The apparatus A of the present invention is illustrated in FIG. 1. The apparatus A is useful in packers and other downhole tools. As illustrated in FIG. 1, the general arrangement of components of a known packer design, apart from the apparatus A, is illustrated. The basic components for actuating the apparatus A are illustrated for a type DB Baker Oil Tools packer. In essence, there is an upper slip 10 and a lower slip 12 which, when the packer P is actuated, are movable toward each other. Slips 10 and 12 ride on inner mandrel 14. The nature and mechanisms used in the past to reduce the space between slips 10 and 12 are well-known and do not constitute a portion of the invention. Situated between the upper slip 10 and lower slip 12 are spring cones 16 and 18. Spring cone 18 has a taper 20 which is driven by taper 22 of upper slip 10. Similarly, taper 24 ultimately abuts taper 26 of lower slip 12. The spring cone 16 is illustrated in detail in FIGS. 3 and 4. Spring cone 18 is functionally identical in the preferred embodiment. It has a gradual taper 24 on one end, while at the same time having a steeper taper 28 at its opposite end. It has a generally cylindrical shape, as seen in FIG. 4, with alternating cut-throughs 30 spaced between solid segments 32. The cut-throughs 30 have narrow gaps of approximately 0.050", in effect making the design as shown in FIG. 3 act as a spring. Since the aggregate movement to flatten the spring cones 16 and 18 is preferably in the order of about 0.200"–0.250", the gaps 30 are very small so that the aggregate movement of either of the spring cones 16 or 18 to the point where the gaps 30 are fully closed falls within the range described. Since the narrow gaps 30 are staggered longitudinally as well as circumferentially at preferably 90°, the overall working of the structure revealed in FIG. 3 is that of a helical spring with a spring rate of approximately 20,000 lbs/in. and a very small overall travel range before full compression. In a given transverse section the narrow gaps are spanned by wider gaps which are generally in longitudinal alignment. The narrow gaps are offset when viewed longitudinally in adjacent transverse sections.

In the preferred embodiment, a V-shaped antiextrusion ring 34 abuts the tapered surface 28. The antiextrusion ring 34 is made up of two segments 36 and 38, keyed together by key 40. On the opposite side from taper 28, antiextrusion ring 34 is abutted by a ring 42, with a pin or other retainer 44 extending therethrough to engage the nonelastomeric sealing element 46. The nonelastomeric sealing element 46 is preferably made from a material having the chemical name polytetrafluoroethylene. Other materials, known by chemical names polyether-etherketone, polyetherketone, polyamide, ethylenetetrafluoroethylene, or chlorotrifluoroethylene, can also be used without departing from the spirit of the invention. Ring 42 has a taper 48 which abuts the antiextrusion ring 34. When the slips 10 and 12 are brought together through actuation of the packer P and longitudinal forces in opposite directions are transmitted into spring cones 16 and 18, the antiextrusion ring 34 moves radially outwardly, as can be seen by comparing FIGS. 1 and 2.

Tapers 48 and 50 redirect the element 46 so that it moves outwardly until it contacts the casing 52. The spring cones 16 and 18 exert opposed forces on the element 46 in the set position shown in FIG. 2. There still remains, however, additional flexibility in the spring cones 16 and 18 when element 46 is in the set position against casing 52. The remaining range of movement before the cut-throughs or gaps 30 are fully compressed allows the spring cones 16 and 18 to flex responsive to growth or shrinkage of the element 46 responsive to temperature fluctuations. In the preferred embodiment, the rings 34 and 54 are identical. The scope of this invention includes the use of a single spring cone, either 16 or 18, or a combination, as shown in FIG. 1.

Figures 2A, 2B, 2C:
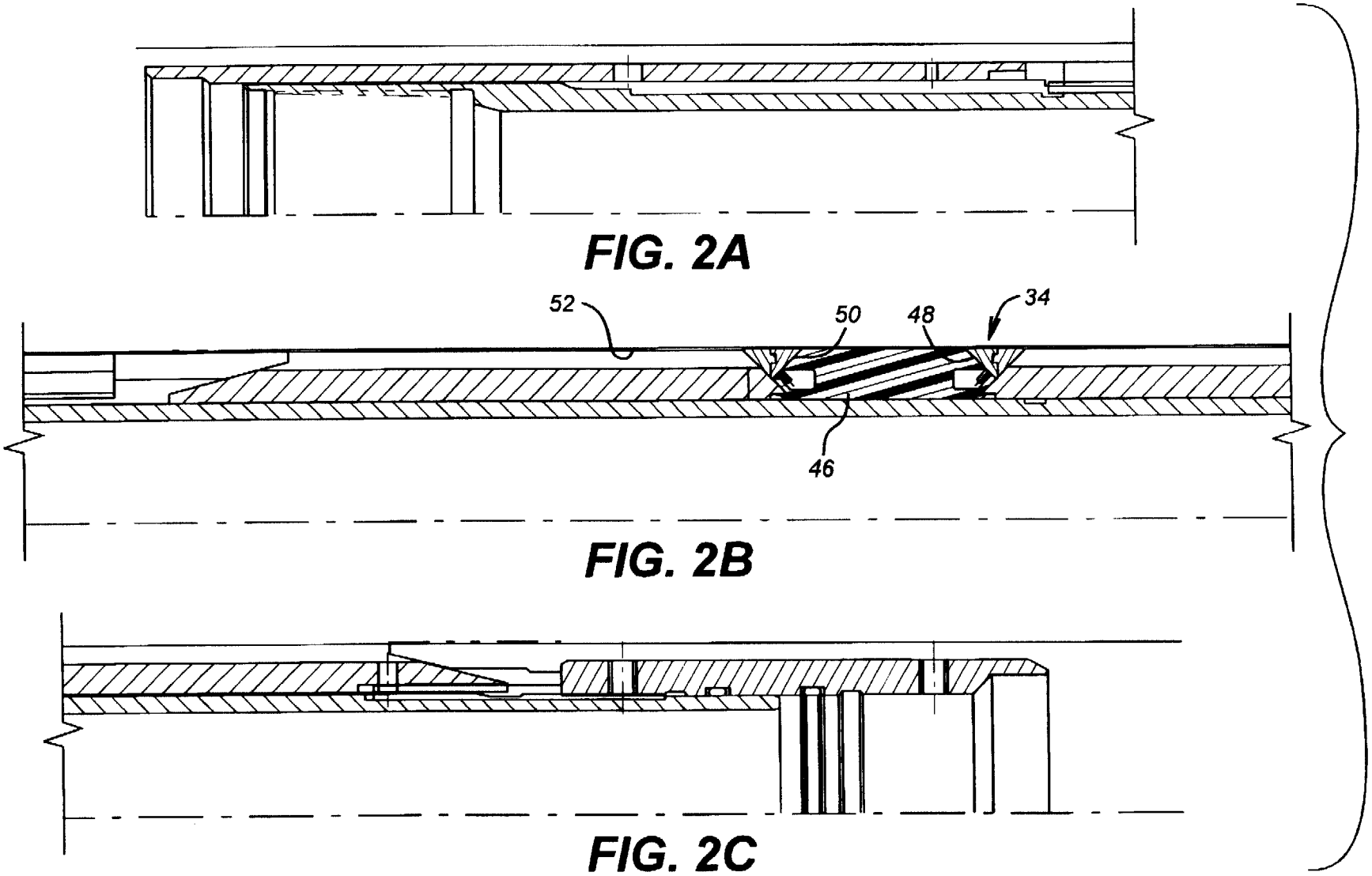
FIGS. 2A–2C is the view of FIG. 1, with the nonelastomeric seal in the set position.

In the configuration illustrated in FIGS. 1 and 2, the packer P may be set at downhole temperatures from about 70° F. to about 450° F. and can withstand temperature fluctuations anywhere within that range without jeopardizing the sealing grip of the element 46 against the casing 52. This is to be contrasted with prior attempts at using nonelastomeric seals which, due to their lack of resilient biasing members such as spring cones 16 or 18, were limited in function to temperature swings of no greater than 100° F. and had to be set in the temperature range of 350° F.–450° F. in order to remain serviceable. Since nonelastomeric materials of the type described above have high coefficients of thermal expansion, the spring cones 16 and 18 easily compensate for growth of the element 46 on increasing temperature and in the reverse direction as well upon decreasing temperature. Pressure shifts, such as when the net differential pressure on the element 46 suddenly shifts from below element 46 to above, are also tolerated without loss of seal by the packer P of the present invention. The available opposed forces created by the preferred embodiment using spring cones 16 and 18 act to compensate against momentary fluctuations of pressure to retain a net force on the sealing element 46 during such transition periods so that sealing contact is maintained against the casing 52 even when the service temperatures exceed about 450° F. or the temperature fluctuations are about 100° F. or more.

While the biasing member, such as spring cones 16 and 18, have been illustrated, different shapes or forms for such members can be employed without departing from the spirit of the invention. For example, coil springs with cylindrical rings on either end can be employed, or other mechanical or hydraulic means for flexibly retaining pressure on the sealing element 46, which has the capacity to compensate for growth or shrinkage of the element 46, are all considered to be equivalents within the scope of the invention. The sealing element 46 may be unitary as illustrated in FIGS. 1 and 2, or it may be in segments. Biasing elements, such as spring cones 16 or 18 or their equivalents as described above, can be deployed on either side of one or more segmented sections of seals such as seal 46.

Other types of aids to resist extrusion at the ends are also within the purview of the invention. The rings 34 and 54 can also optionally be eliminated and the spring cones 16 and 18 configured in such a way so that they can bear directly on element 46 while at the same time retaining features that would resist end extrusion of sealing element 46.

The specific design of the spring cones 16 and 18 illustrated in FIG. 3 has greater structural rigidity than an open coil spring and further allows for control of how much total motion can occur before the assembly is compressed so that it begins to function as a solid cylinder. Since the cut-through sections 30 are small, as are the windows 56 adjacent thereto, the resulting construction is strong in resisting torsional forces which may be imparted to it through the spring cones 16 and 18. The spring cone 16 is keyed at key 58 to a groove 60 to reduce any tendency to apply a torque to the sealing element 46 during operation of the packer P.

The foregoing disclosure and description of the invention are illustrative and explanatory thereof, and various changes in the size, shape and materials, as well as in the details of the illustrated construction, may be made without departing from the spirit of the invention.

I claim:

1. A sealing system for a downhole tool, comprising:

a body having a longitudinal axis;

a nonelastomeric sealing element on said body;

compressing means on said body to longitudinally compress said sealing element downhole; and at least one biasing member, said biasing member capable of storing a potential energy force, said biasing member mounted to said body such that after actuation of said compressing means, a substantially longitudinal biasing force is exerted on said nonelastomeric sealing element which varies in response to varying thermal or fluid pressure loads acting on said nonelastomeric element;

said biasing member further comprises a cylindrically shaped element having a plurality of circumferential openings and a longitudinal axis;

said openings are elongated and substantially transverse to said longitudinal axis; and said openings comprise narrow width openings and wider width openings.

2. The system of claim 1, wherein:

said openings alternate between narrow and wide on any plane transverse to said longitudinal axis where said openings are found.

3. The system of claim 1, wherein:

said narrow openings staggered circumferentially as between adjacent planes transverse to said longitudinal axis to define a generally spiral pattern around said cylindrically shaped element.

4. The system of claim 3, wherein:

said cylindrically shaped element is formed with no other openings between pairs of narrow openings when viewed in a direction parallel to said longitudinal axis.

5. The system of claim 4, wherein:

said wider openings are substantially in alignment when viewed in a direction parallel to said longitudinal axis.

6. The system of claim 3, wherein:

said cylindrically shaped element capable of longitudinally flexing wherein one limit of said flexing occurs when said narrow width circumferential openings close up.

7. The system of claim 6, further comprising:

at least one antiextrusion ring disposed between said sealing element and said biasing member.

8. The system of claim 7, wherein:

said antiextrusion ring moves outwardly away from said body with said element which is growing radially in response to an applied longitudinal force initiated by said compressing means.

9. The system of claim 8, wherein:

said antiextrusion ring comprises at least one taper which interacts with a mating taper on said element to redirect said element outwardly away from said body responsive to activation of said compressing means.

10. The system of claim 9, wherein:

said antiextrusion ring comprises at least two tapers, with one of said tapers contacting a mating taper on said biasing member, whereupon when said compressing means is actuated, said biasing member cams said antiextrusion ring outwardly away from said body as said element expands in the same direction.

11. The system of claim 10, wherein:

said biasing member is movable longitudinally and is locked to said body against rotation.

12. The system of claim 7, wherein:

said sealing element is constructed from a material that can seal in the wellbore at temperatures at least 450° F. and temperature variations of at least 100° F.

13. The system of claim 3, wherein:

said sealing element is constructed from a material that can seal in the wellbore at temperatures at least 450° F. and temperature variations of at least 100° F.

14. The system of claim 1, wherein:

said biasing member is movable longitudinally and is locked to said body against rotation.

15. The system of claim 1, further comprising:

at least one antiextrusion ring disposed between said sealing element and said biasing member.

16. The system of claim 15, wherein:

said antiextrusion ring moves outwardly away from said body with said element which is growing radially in response to an applied longitudinal force initiated by said compressing means.

17. The system of claim 16, wherein:

said antiextrusion ring comprises at least one taper which interacts with a mating taper on said element to redirect said element outwardly away from said body responsive to activation of said compressing means.

18. The system of claim 17, wherein:

said antiextrusion ring comprises at least two tapers, with one of said tapers contacting a mating taper on said biasing member, whereupon when said compressing means is actuated, said biasing member cams said antiextrusion ring outwardly away from said body as said element expands in the same direction.

19. The system of claim 18, wherein:

said antiextrusion ring comprises, when viewed in section, two triangular shapes keyed together.

20. The system of claim 1, wherein:

said sealing element is constructed from a material that can seal in the wellbore at temperatures at least 450° F. and temperature variations of at least 100° F.

21. The sealing system of claim 1, wherein:

said cylindrically shaped element capable of longitudinally flexing wherein one limit of said flexing occurs when said openings close up.

* * * * *